US010246887B2

(12) United States Patent
Motavalli et al.

(10) Patent No.: US 10,246,887 B2
(45) Date of Patent: Apr. 2, 2019

(54) METHOD FOR PRODUCING PRESTRESSED STRUCTURES AND STRUCTURAL PARTS BY MEANS OF SMA TENSION ELEMENTS, AND STRUCTURE AND STRUCTURAL PART EQUIPPED THEREWITH

(71) Applicants: RE-FER AG, Wollerau (CH); EIDGENÖSSISCHE MATERIALPRÜFUNGS-UND FORSCHUNGSANSTALT EMPA, Dübendorf (CH)

(72) Inventors: Masoud Motavalli, Rüschlikon (CH); Benedikt Weber, Schaffhausen (CH); Wookijn Lee, Cheonan-si (KR); Rolf Broennimann, Wiesendangen (CH); Christoph Czaderski, Gossau (CH); Christian Leinenbach, Fehraltdorf (CH); Julien Michels, Zürich (CH); Moslem Shahverdi, Dübendorf (CH)

(73) Assignees: RE-FER AG, Wollerau (CH); EIDGENOESSISCHE MATERIALPRUEFUNGS-UND FORSCHUNGSANSTALT EMPA, Dübendorf (CH)

( * ) Notice: Subject to any disclaimer, the term of this patent is extended or adjusted under 35 U.S.C. 154(b) by 0 days.

(21) Appl. No.: 15/537,295

(22) PCT Filed: Dec. 14, 2015

(86) PCT No.: PCT/EP2015/079607
§ 371 (c)(1),
(2) Date: Jun. 19, 2017

(87) PCT Pub. No.: WO2016/096737
PCT Pub. Date: Jun. 23, 2016

(65) Prior Publication Data
US 2017/0314277 A1 Nov. 2, 2017

(30) Foreign Application Priority Data
Dec. 18, 2014 (CH) ..... 1980/14

(51) Int. Cl.
*E04C 5/01* (2006.01)
*E04C 5/08* (2006.01)
(Continued)

(52) U.S. Cl.
CPC ..... *E04G 21/12* (2013.01); *C22C 38/00* (2013.01); *C22C 38/105* (2013.01); *C22C 38/14* (2013.01);
(Continued)

(58) Field of Classification Search
CPC ..... Y10T 29/49863; Y10T 29/49865; Y10T 29/49632; Y10T 29/49361;
(Continued)

(56) References Cited

FOREIGN PATENT DOCUMENTS

DE 15 59 116 A1 8/1969
GB 2358880 A 8/2001
(Continued)

OTHER PUBLICATIONS

International Search Report for PCT/EP2015/079607 dated Mar. 24, 2016 (7 pages).*
(Continued)

*Primary Examiner* — Jason L Vaughan
(74) *Attorney, Agent, or Firm* — Edwin D. Schindler

(57) ABSTRACT

The method includes a tension element, for example in the form of flat steel, that is placed on the structure or structural part and can be guided around a corner. The flat steel can also wrap as a band around the structure, in which the two ends of the flat steel are either connected to one another or are separately connected to the structure by the end anchors or intersect to produce a clamping connection. The flat steel
(Continued)

contracts as a result of a subsequent active and controlled input of heat using a heating element and generates a permanent tensile stress and, correspondingly, a permanent prestress on the structure. The structure, as equipped, has at least one tension element as a shape memory alloy which extends along the outer side of the structure and is connected by one or more end anchors.

10 Claims, 3 Drawing Sheets

(51) Int. Cl.

| | |
|---|---|
| ***C22C 38/00*** | (2006.01) |
| ***C22C 38/10*** | (2006.01) |
| ***C22C 38/14*** | (2006.01) |
| ***E04G 21/12*** | (2006.01) |
| ***E04G 23/02*** | (2006.01) |

(52) U.S. Cl.
CPC ..... *E04C 5/01* (2013.01); *E04C 5/08* (2013.01); *E04G 23/0218* (2013.01); *E04G 23/0225* (2013.01); *E04G 2021/127* (2013.01); *Y10T 29/49632* (2015.01); *Y10T 29/49863* (2015.01); *Y10T 29/49865* (2015.01)

(58) Field of Classification Search
CPC ..... Y10T 29/49616; Y10T 29/49618; Y10T 29/49631; E02D 5/105; E02D 5/12; E02D 27/08; E02D 2250/0053
USPC ..... 264/228, 229, 230, 231
See application file for complete search history.

(56) References Cited

FOREIGN PATENT DOCUMENTS

| | | | |
|---|---|---|---|
| WO | WO 96/12588 | A1 | 5/1996 |
| WO | WO 2014/134136 | A1 | 9/2014 |
| WO | WO 2014/166003 | A2 | 10/2014 |

OTHER PUBLICATIONS

Comparing the cyclic behavior of concrete cylinders confined by shape memory alloy wire or steel jackets, Park et al., Aug. 30, 2011, Smart Material and Stuctures.*

Confining concrete cylinders using shape memory alloy wires, Choi et al., 2008, The European Physical Journal.*

The confining effectiveness of NiTiNb and NiTi SMA wire jackets for concrete, Choi et al., Feb. 10, 2010, Smart Material and Structures.*

3D Finite Element Modeling to Study the Behavior of Shape Memory Alloy Confined Concrete, Chen et al., 2012, 15 WCEE Lisboa 2012.*

* cited by examiner

METHOD FOR PRODUCING PRESTRESSED STRUCTURES AND STRUCTURAL PARTS BY MEANS OF SMA TENSION ELEMENTS, AND STRUCTURE AND STRUCTURAL PART EQUIPPED THEREWITH

BACKGROUND OF THE INVENTION

Technical Field of the Invention

The present invention refers to a method for producing tensioned structural parts in new constructions (which are cast on the construction site) or for prefabrication as well as subsequent reinforcement of existing structures or generally of any structural part. Tension elements made of shape memory alloys, which are called shape-memory-alloy-profiles or in short SMA-profiles by the skilled in the art, are applied for subsequent application of tension to the structure. By this, subsequent tensioning extensions may also be mounted under prestress on an existing structure. The invention also refers to a structure or structural part, which has been produced or subsequently reinforced by applying said method, or on which extensions were docked according to this method. In particular, to this end, for generating the prestress, shape memory alloys based on steel are used as tension elements or tie rods.

Description of the Prior Art

A prestress of a structure in general increases its serviceability, since existing cracks are reduced, the formation of cracks is generally prevented or appears only at higher loads. Such a prestress is nowadays used for reinforcing against bending of concrete parts or for binding of posts, for example, for increasing the axial load capacity or for increased resistance to pushing forces. The new battery factory, "Gigafactory," of Tesla in Nevada, USA, should become the largest factory in the world, while 1 million square meters of building surface, i.e. two floors each having a surface area of 500,000 square meters (the previous largest factory of aircraft manufacturer Boeing in Everett in the State of Washington, USA, comprises a total of 400,000 square meters). For the foundation of the "Gigafactory" concrete blocks of 20 m×5 m are set one beside the other in a row. Each such concrete block will then support one of hundreds of columns (Neue Zürcher Zeitung, NZZ, no. 272, 22, November 2014, page 35). The stability of such a concrete block is considerably increased and the blocks are provided with much better protection against future crack formation by the circumferential binding with an SMA-tension band.

A further application of prestress of structural parts of concrete or other construction materials are pipes for transporting liquids and silos or fuel containers, which are bound for generating a prestress. For prestressing, in the state of the art, round steel or cables are introduced into concrete or construction material or subsequently externally fixed on the surface of structural part on the tension side. The anchoring and force transmission from the tension element in the concrete in all these known methods are complicated. Anchor elements (anchor heads) are very expensive. In case of external prestress it is required to additionally protect the prestress steels and cables with a coating against corrosion. This is necessary since conventional steels are not corrosion-proof. If the prestress cables are inserted into concrete, it is necessary to protect them against corrosion by means of concrete mortar, which is injected into the jacket tubes. An external prestress is also generated in the state of the art by means of fiber composite materials, which are adhered on the concrete surface or on a structure or structural part. In this case the fire protection is often very complicated, since the adhesives have a low glass transition temperature.

The corrosion protection is the reason because in traditional concrete a minimum overlap of steel inclusion of about 3 cm has to be maintained. Due to environmental agents (namely $CO_2$ and $SO_2$ in air), a carbonation takes place in the concrete. Because of this carbonation, the basic environment in concrete (pH of 12) falls to a lower value, i.e. a pH between 8 and 9. If the inner armature is located in this carbonated region, the corrosion protection of conventional steel can no longer be ensured. The 3 cm thick overlapping of steels correspondingly ensures a corrosion resistance of the inner armature for a lifetime of structure of about 70 years. In case of use of new shape memory alloys, carbonization is much less critical, since the new shape memory alloys, with respect to conventional construction steel, has a much higher resistance to corrosion. Due to prestress of a concrete part or mortar, cracks are closed and consequently penetration of contaminants is very reduced.

SUMMARY OF THE INVENTION

The object of the present invention is therefore to provide a method for prestressing new structures and structural parts of any kind for reinforcement, optionally for improving the usability or fracture condition of structure or structural part, for ensuring a more flexible use of building for subsequently protruding extensions, or for increasing the durability as well as the fire resistance of structure or structural part. A further object of the invention is to provide a structure and a structural part, which is provided with prestresses or reinforcements created by using the present method.

The object is firstly achieved by a method for producing prestressed structures or structural parts made of concrete or other materials, by means of tension elements made of a shape memory alloy, whether for new structures and structural parts or for reinforcing existing structures and structural parts, which is characterized in that at least one tension element of a shape memory alloy having a polymorphic and polycrystalline structure, which, by increasing its temperature, can be brought from its martensitic state to its permanent austenitic state, may be applied on the structure or structural part or may be placed, in a free extending state, on the structure or structural part or in that this tension element is guided at least around a corner, wherein one or more end anchors penetrate into said structure or structural part, or the tension element wraps around a structure or structural part one or more times, as a band, wherein in this case both ends of tension element are either connected to each other by tensile connection or are connected separately by one or more end anchors or intermediate anchors, respectively, which penetrate in the structure or structural part, to the same, or the tension element overlaps or crosses itself one or multiple times, in a clamping manner, and that the tension element, due to subsequent active and controlled heat input by heating means, contracts and generates a permanent tensile stress and correspondingly generates a permanent prestress as well as a residual tension up to breaking load of tension element on structure or structural part.

The object is also achieved with a structure or structural part, which is produced by this method, which is characterized in that it has one tension element made of a shape memory alloy, which extends along the side of structure or structural part or is applied in a free extending way on the structure or structural part and is connected with the same by means of end anchors or an additional adhesion, or the structure or structural part is entirely wrapped around by the tension element, in the form of a band, wherein both end regions of tension element are connected by end anchoring or by tensile force, and the tension element is permanently prestressed by heat input.

With this new development it is possible to subsequently effectively prestress structures and structural parts like terrace extensions, terrace rails, pipes, etc., may be provided with smaller thicknesses. The structural parts used are therefore lighter and more cost-effective.

BRIEF DESCRIPTION OF THE DRAWING FIGURES

The method is described and explained by means of drawings. Applications for new constructions as well as prefabrications and applications for subsequent reinforcement of existing structures are described and explained, no matter which construction material is used, as well as concrete constructions and other structural parts.

In particular:

DETAILED DESCRIPTION OF THE DRAWING FIGURES AND PREFERRED EMBODIMENTS

Figure 1:
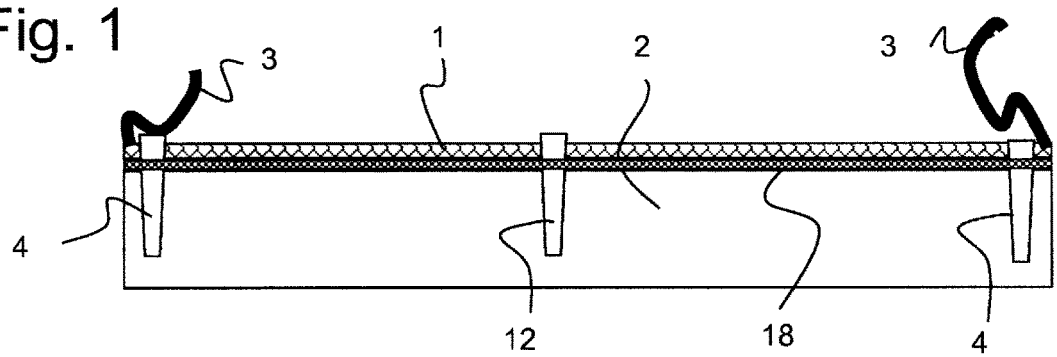
FIG. 1 shows a concrete support or concrete slab, which is cast on construction site or in the prefabrication site, with applied end-anchored tension element, formed by an SMA flat steel made of a shape memory alloy and an optional additional gluing.

Initially, the nature of the shape memory alloys (SMA) has to be understood. These are alloys, which have a particular structure, which may be modified by heat and which, after heat removal, return to their initial condition. Like other metals and alloys, shape memory alloys (SMA) contain more than one crystalline structure, i.e. they are polymorphic and therefore polycrystalline metals. The dominating crystalline structure of shape memory alloys (SMA) depends, on one side, on their temperature, and on the other side, on the stress acting from outside—either tension or pressure. At high temperatures, the structure is austenitic, whereas it is martensitic at low temperatures. The particularity of these shape memory alloys (SMA) is that they recover their initial structure and form, after increasing their temperature, in the high temperature phase, even if they have been previously deformed in the low temperature phase. This effect may be used in order to apply prestresses within structures.

If no heat is artificially introduced or removed into and from the shape memory alloy (SMA), the shape memory alloy is at ambient temperature. The shape memory alloys (SMA) are stable within a specific temperature range, i.e. their structure does not vary within certain limits of mechanical loading. For applications in the construction sector in an outdoors environment the fluctuation range of ambient temperature is assumed to be between −20° C. and +60° C. Therefore, within this temperature range, a shape memory alloy (SMA), which is used to this end, should not exhibit structural modifications. The transformation temperatures, at which the structure of shape memory alloy (SMA) varies, may strongly depend on composition of shape memory alloy (SMA). The transformation temperatures are therefore load-dependent. At rising mechanical loading of the shape memory alloy (SMA), its transformation temperatures also rise. If the shape memory alloy (SMA) has to remain stable within certain temperature limits, particular care has to be taken regarding these limits. If shape memory alloys (SMA) are used for structural reinforcements, care must be taken not only with regard to corrosion resistance and relaxation effects, but also with respect to fatigue resistance of shape memory alloy (SMA), in particular when loads vary in time. A differentiation has to be made between structural fatigue and functional fatigue. Structural fatigue refers to accumulation of micro-structural defects as well as the formation and propagation of surface cracks, up to final material failure. Functional fatigue, on the other hand, refers to the effect of gradual degradation either of the shape memory effect or the damping capacity due to micro-structural modifications in the shape memory alloy (SMA). The latter is connected to the modification of the stress-strain curve under cyclical load. The transformation temperatures are here also modified.

In order to resist to sustain loads in the construction sector, shape memory alloys (SMA) based on iron Fe, manganese Mn and silicon Si are suitable, wherein addition of up to 10% chrome Cr and nickel Ni provides the shape memory alloy with a corrosion behavior similar to stainless steel. In literature, it is shown that the addition of carbon C, cobalt Co, copper Cu, nitrogen N, niobium Nb, niobium carbide NbC, vanadium-nitrogen VN and zirconium carbide ZrC may improve the characteristics of shape memory in different ways. Particularly good properties are provided in a shape memory alloy (SMA) made of Fe—Ni—Co—Ti, which resists to fracture stresses up to 1000 MPa, is highly corrosion-resistant and has an upper temperature of transition to austenitic state of about 100-250° C. The prestress (recovery stress) in this alloy is usually 40-50% of fracture load.

The present reinforcement system peruses the properties of shape memory alloys (SMA) and preferably those shape memory alloys (SMA) based on steel, which is much more corrosion-resistant than construction steel, since such shape memory alloys (SMA) are notably more cost effective than SMA made of nickel-titanium (NiTi), for example. The steel-based shape memory alloys (SMA) are preferably used in the form of flat steels.

Fundamentally, according to this method, a flat steel made of a shape memory alloy, in short a SMA flat steel, is applied on a structure or structural part and is anchored to the same with its end regions. Optionally, the flat steel is provided with intermediate anchors, if needed. An additional gluing is reasonable for security reasons. Thence, heating of SMA flat steel takes place by supply of electric current. Due to heating, the glue is softened, but this is not problematic, since the adhesive hardens again after cooling and may guarantee safety in the end state. This causes a contraction of the SMA flat steel and correspondingly a prestress on the structure or structural part. The prestress forces are introduced at the end regions of the SMA flat steel through the end anchors into the structure or structural part.

In prefabrication of reinforced concrete parts, such as terrace or façade-slabs or pipes, on which the new SMA steel profiles are applied and prestressed, further advantages are provided. Due to prestressing of these prefabricated concrete parts, the cross sections of structural part may be reduced. Since the structural part, due to internal prestress, is free of cracks, protection against penetration of chloride or carbonization is increased. This means that such parts are not only lighter but also much more resistant and therefore durable. The invention may also be used for better protecting a structure against fires, wherein the direct contraction of SMA flat steels by heat input is initially deliberately omitted. In case of fire, however, the mounted SMA flat steels contract due to heat of fire.

A building shell made of concrete, which is reinforced by SMA flat steels, therefore generates, in case of fire, an automatic prestress and hence a better resistance to fire. The structure is, so to speak, completely clamped together in case of fire, and will collapse much later, if at all.

Further application fields:

- connection of pipes, made of steel or cast iron, for example.
- in case of earthquake-protection or wind-protection in timber frames, the tension elements are diagonally fixed, by passing through the steel connectors, at respective corners (by nailing or screwing).
- different fixing methods: nailed or screwed on wood, screwed or riveted on steel, mechanical anchoring on concrete or brickworks.

Essentially, it is about a method for producing prestressed concrete structures or structural parts 4, as schematically shown in FIG. 1, by means of tension elements made of SMA-alloy, as shown here, in the form of flat steels 1 made of such a shape memory alloy, whether or new structures and structural parts 2 or for reinforcement of existing structures made of concrete, stone or other construction materials. To this end, at least one flat steel 1 made of a shape memory alloy with a polymorph and polycrystalline structure, which may be brought, by increasing its temperature, from its martensitic state to its permanent austenitic state, is initially applied on or at the structure or structural part 2. The application on or at the structure may also take place around corners or may completely surround or wrap around a part. One or more end anchors 4 deeply penetrate into the structure or structural part 2. If the flat steel 1 encloses the structure or structural part 2 one or multiple times, both ends of the flat steel 1 may either be connected to each other by tensile coupling or may be separately connected, with one or multiple end anchors 4, which penetrate into the structure or structural part 2, with the same, or they cross each other one or multiple times for clamping. Obviously, also intermediate anchors 12 may be used. The flat steel 1 then contracts, due to an active and controlled heat input by means of heating means and generates a permanent tension and correspondingly a permanent prestress on the structure or structural part 2. As shown in FIG. 1, electric leads 3 are provided, in order to apply an electric voltage to the flat steel, which induces a current flow through the same. Due to the electric resistance of the tie rod, this becomes hot and is therefore transitioned to the permanent contracted austenitic state. Additionally, between the flat steel and the structure or structural part a suitable adhesive 18 for additional gluing may be introduced, based on epoxy or PU, for example. In this case, tension elements are used, which are provided, at least on their side directed towards the adhesive, with a rough surface, for improving the adhesive bond. Optionally, the end anchor, in case of such gluing, may also be used only for generating a prestress force, and a safety reserve may be provided, so that the transmission of the fracture load to the tension elements in the structure or structural part only takes place through the hardened adhesive. On the other hand, in case of use of end anchors and an additional gluing, the end anchors or optional intermediate anchors may be removed after contraction of tension elements, because of space limitations or for aesthetic reasons. The end anchors may possibly be dimensioned in a way that it only has to withstand the prestress of the tension element due to heating with the additional safety reserve. The additional composite obtained by gluing offers additional safety, since in case of a damaged tension element, the risk of explosive bursting is strongly reduced. This is important for personal protection, in particular when passerby may be stationing near the structure, as normal inside city areas.

Figure 2:
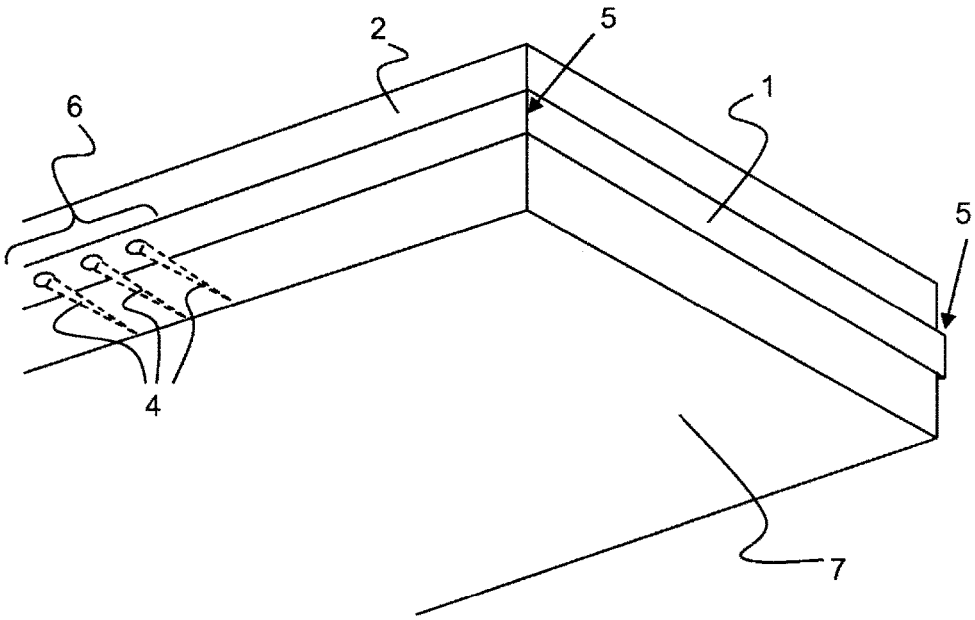
FIG. 2 shows a concrete structural part, which is surrounded on three sides by a tension element formed by a flat SMA flat steel.

FIG. 2 shows an application, in which a tension element 1 formed by a flat steel is guided around two corners 5 of a projecting concrete slab 2. In both corner regions of flat steel, it is fixedly connected to the concrete slab 2 by means of a plurality of end anchors 4. Due to heating by applying a voltage between both ends of tension element 1 or flat steel, this flat steel is permanently contracted and generates a permanent prestress around this side of the concrete slab.

This slab is more stable and remains crack-free. The tension element 1 or the flat steel may have end anchors and additional intermediate anchors, or it tension may be transmitted to the structure also through gluing, or the transmission of force takes place by a combination of mechanical anchors and adhesion.

Figure 3:
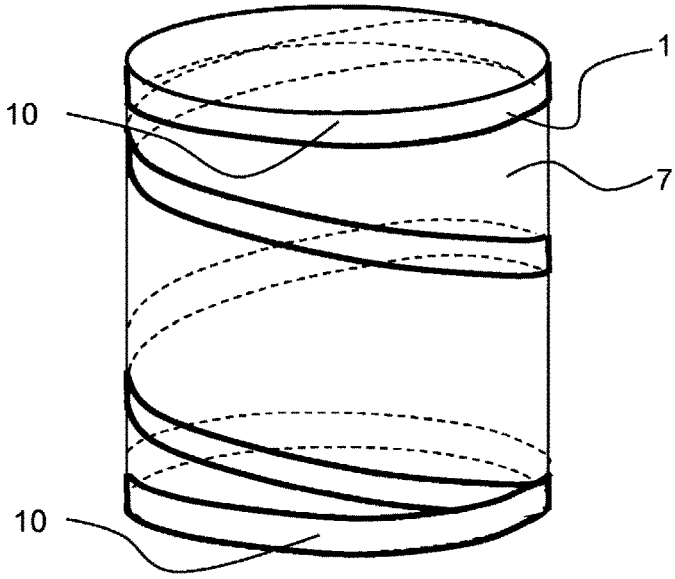
FIG. 3 shows a cylindrical structural part, which is wrapped around by an SMA flat steel, with formation of overlapping regions.

FIG. 3 shows an application, in which a tension element 1 has been wrapped around a structural part in the form of a SMA flat steel. Since the flat steel at one end of the cylindrical structural part, a column, for example, has been guided more than one time as a band around the same, and it is then wrapped around upwards, as a band along a helical line around the cylindrical part, and is also wrapped in an overlapping way at the upper end still multiple times around the part, a strong end anchor is barely required. The contraction of the flat steel band causes a clamping on both end rings 10, and also along the entire winding, due to the contraction, a very strong binding of part is caused, substantially stabilizing the same and protecting it against the formation of cracks. This application by means of wrapping may also be used for reinforcing of concrete pipes or similar.

Figure 4:
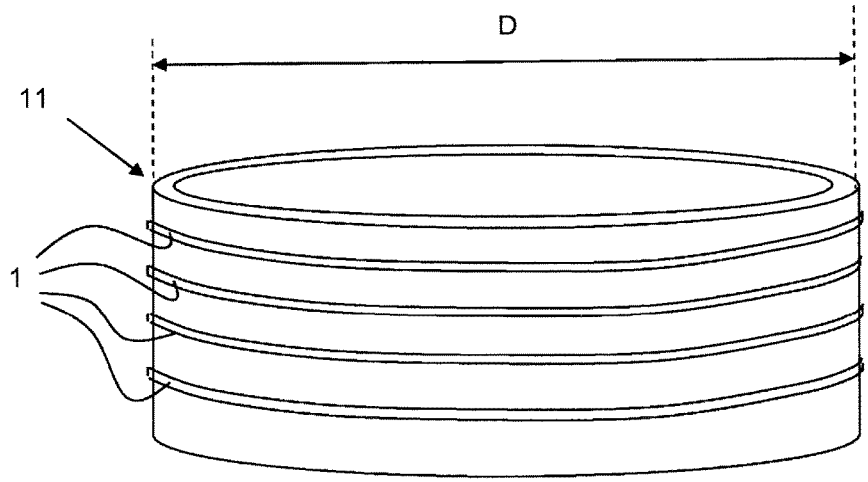
FIG. 4 shows a silo, which is wrapped around by wrapping tension elements formed by SMA band steel.

FIG. 4 shows an application on a large silo 11 with a diameter of several meters, like a liquid tank, whether it is made of concrete or steel segments. In this case, plural tension elements 1 are wrapped around the entire structure at specific distances from each other; wherein the overlapping end regions are dynamically connected and then contract through heat input, so that a solid and durable prestressed binding is created, which strongly reinforces the structure.

Figure 5:
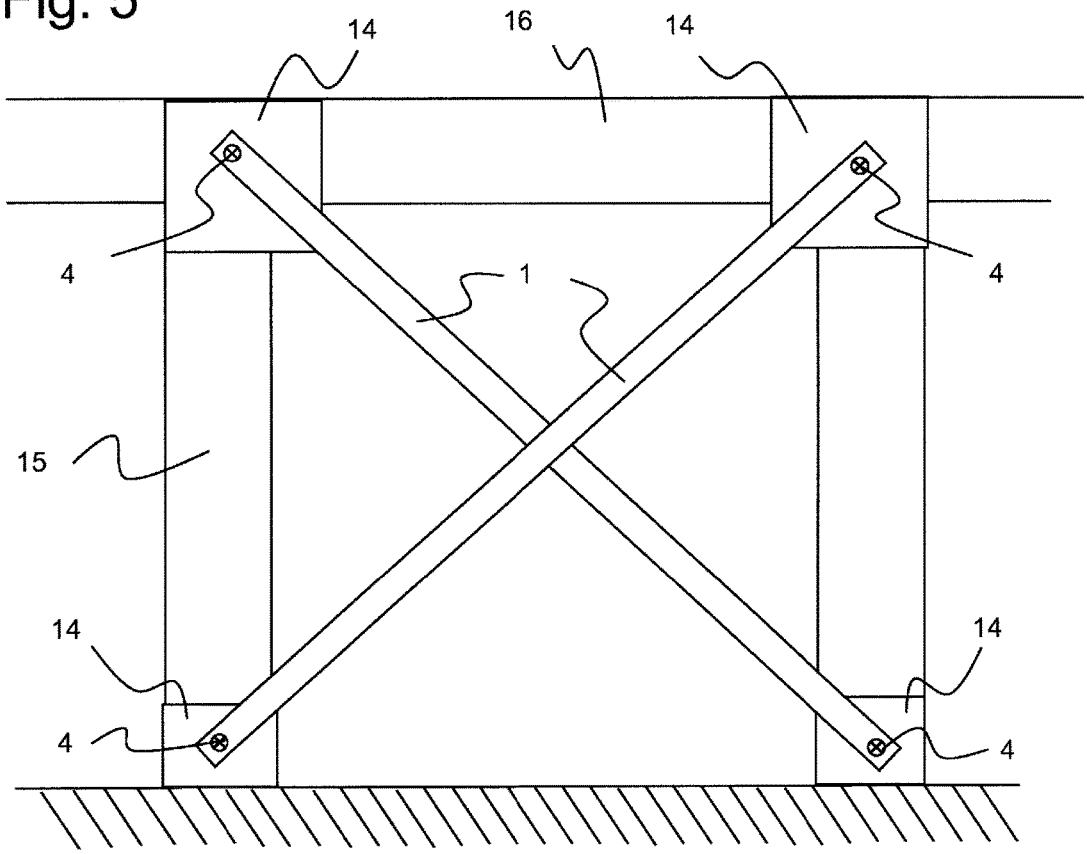
FIG. 5 shows a wood construction with tension elements of SMA profiles, which are tensioned crosswise, for increasing stability of construction.

FIG. 5 shows an application in a timber frame construction. The timber constructions with vertical supports 15 and beams 16 supported thereon are widespread, wherein the beams 16 and supports 15 are screwed or nailed to each other by special steel connector elements 14. The steel connector elements 14 are connected to each other, as shown, with mutually crossing tension elements 1 formed by SMA-profiles, wherein the end anchors are provided by bolts, which pass through the steel connector elements and SMA-profiles. The passing through takes place in that the SMA-profile as well as the steel connector element are pre-drilled and subsequently a nail or a screw is introduced through both elements into the wood. Then heat is input and the SMA-profiles contract and stress the timber construction, whereby a previously unknown stability is achieved.

Figure 6:
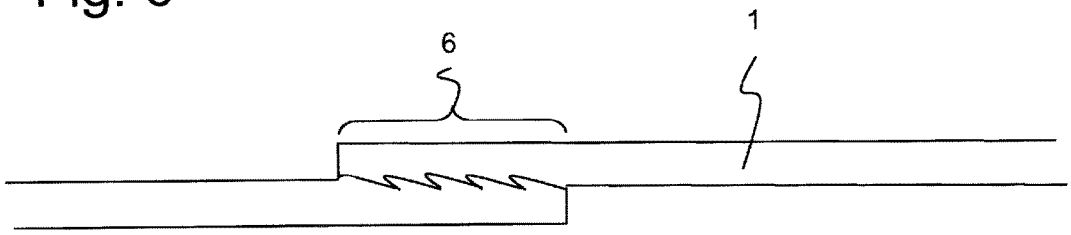
FIG. 6 shows a connection of two tension elements overlapping at their end regions, by means of clawing.
Figure 7:
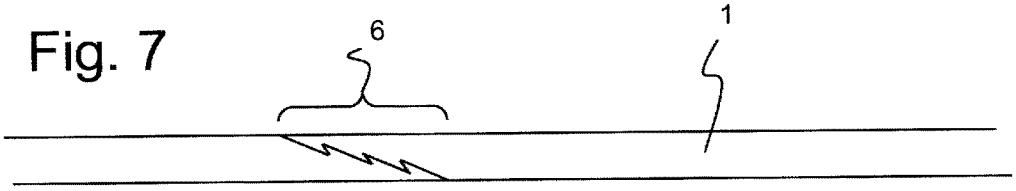
FIG. 7 shows a variant of clawing of end regions of a SMA flat steel with externally flush transition.
Figure 8:
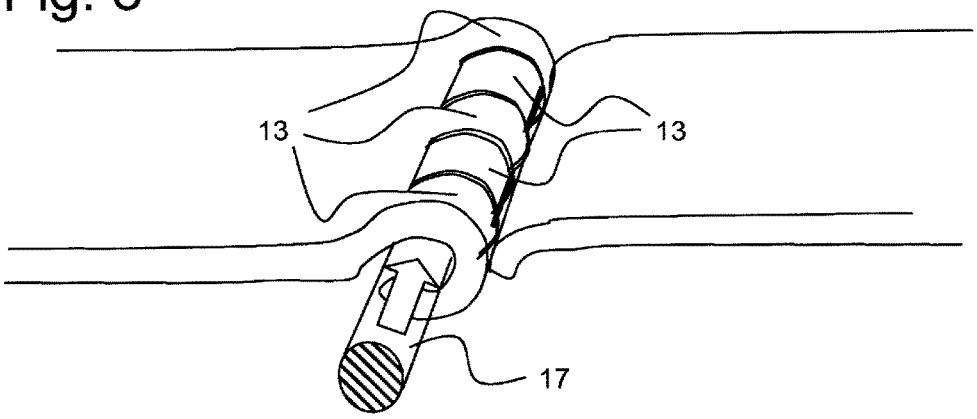
FIG. 8 shows a further variant of clawing of end regions of a SMA flat steel with externally flush transition, with an additional fixing by means of transverse threaded bolts; and, FIG. 9 shows a further preferred embodiment of a connection, wherein end regions of the flat steels are formed in two equally thick barbs which engage with one another via a form fit.
Figure 9:
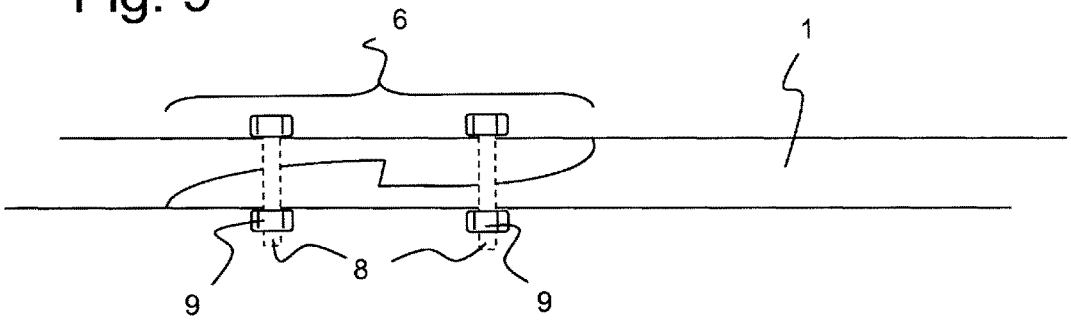

The end anchors of flat steels may be in provided according to different embodiments. FIGS. 6 to 9 show related examples. FIG. 6 shows a variant, in which the end regions 6 of flat steels have a toothing in their surface region. Two flat steels 1 may be overlaid so that their toothings engage each other, so that a clawing and a full composite is formed. This composite may be secured by a band wrapping or by means of screws, whereby it cannot be released as long as it is subject to traction. Instead of the connection of two flat steels, this connection may also be used when both identical end regions of a single flat steel are overlaid due to wrapping of a structural part. FIG. 7 shows an example, where the connection is such that both flat steels extend with coplanar upper and lower sides, so that a flush transition is created. In this case, in the end region 6 of flat steel a helical gear is formed, which may also be secured by a screwed connection or a wrapping band. FIG. 8 shows a connection, in which the ends of flat steels to be connected to each other are formed by open hoods, wherein in the example shown, the flat steel coming from left has three of such hooks 13, each having a cavity between the hooks 13. In the two cavities formed, two identical hooks 13 engage, which, in the example shown, are positioned at the ends of the flat steel coming from the right side, which are curved upwards instead of downwards. After mutual insertion of hooks 13 of both flat steels, a bolt 17 is pushed laterally inside the hooks 13, which bolt then crosses the inner space of hooks 13. In this way, the hooks are connected to each other by a force fit. FIG. 9 shows a further connection, in which the end regions 6 of flat steels are formed in two equally thick barbs, which engage with each other with a form fit, wherein the connection may also be secured, as shown, by a screwed connection, by connecting two points, as shown, for example, in which a respective screw 8 or bolt passes through both flat steels and locks them finally to each other by means of a lock nut 9. In case of bolts it is to be considered that the prestress is considerably smaller than the fracture load of tension element, so that along the tension elements smaller cross sections are required than in the case of the anchor.

The connection of the end regions of the flat steels may therefore be generally achieved in that on overlapping sides of end regions 6, the latter engage one another by clawing with a form fit. However, they can also be simply mechanically connected to each other in the overlapping portions, only by one or more screws 8 with a tensile force fit, wherein the pass-through screws 8 are tightened by a lock nut 9. A further possibility for anchoring consists in that at least one flat steel 1 made of a shape memory alloy is wrapped, as a band, around the structural part 7, so that the band overlaps over a region, where subsequently, between electric contacts on the end regions of band a voltage is applied, so that the flat steel 1, due to its electric resistance, heats up, and transitions from its martensitic state to its permanent austenitic state. A permanent binding of structural part 7 is therefore achieved.

A structure or structural part, which is provided with such an SMA-flat steel always has at least one tension element 1 in the form of a flat steel made of a shape memory alloy, which extends along the outside of the structure or structural element, and which is connected to the same by end anchors 4. As an alternative, the structure or structural part 7, as shown in FIG. 3 or 4, may be entirely surrounded or wrapped around by one or multiple flat steels 1, wherein both end regions of flat steels 1 are connected with a tensile force fit, and the one or more flat steels 1 are permanently prestressed by heat input. The windings may also form overlapping regions, so that the flat steel 1 after heat input and contraction, causes a permanent binding of structural part 7 and the overlapping regions 10 generate an adhesive friction force, which is sufficient for obtaining the binding.

In fact, in case of heat input, the alloy contracts permanently back into its original state. If the SMA flat steels are heated up to the temperature of austenitic state, they reach their original form and keep it, even under load. The effect achieved with these shape memory alloys (SMA) is a prestress over the structure or mounted structural part, wherein this prestress uniformly or linearly extends along the entire length of the profile made of a shape memory alloy.

For subsequent reinforcement, the SMA flat steel is applied, in any direction, however primarily in the direction of tension, on a concrete structure, and is anchored to the same on one end. Then, the SMA flat steels are heated by electricity, which causes a contraction of these SMA flat steels. The contraction causes a prestress and the forces are either directly transmitted through the end anchors in the concrete structure or part, or, in case of wrappings, even over the entire length of the steel profile.

In case of prefabrication of reinforced concrete parts, like terrace slabs or façade slabs or pipes, on which the new SMA flat steels are applied and prestressed, further advantages apply. Due to the prestress of these prefabricated concrete structural parts, the cross sections of the part may be reduced. Since the structural part is free of cracks, due to the prestress, a higher protection against penetration of chloride or carbonization is provided. This means that such structural parts become lighter but also much more resistant and correspondingly durable.

The heating of the SMA flat steels 1 advantageously takes place electrically by installation of a resistance heating, in that a voltage is applied on the applied heating cables 3, as shown in FIG. 1, so that the SMA flat steel or the SMA flat steel band 1 heats up like an electric conductor. Since, in case of long SMA flat steels or bands, the heating by electric resistance heating would take too much time, and too much heat would be introduced into the concrete, a plurality of electric connectors is installed along the length of the SMA flat steel or band. The SMA flat steel may then be heated in steps, in that a voltage is applied on two respective neighboring heating cables, and then on two successive neighboring cables, etc., until the entire SMA flat steel has been brought in the austenitic state. To this end, high voltages and currents are required for short periods of time, which cannot be provided by a normal power supply at 220 V/110 V or a normal voltage source at 500 V of construction sites. The voltage is provided, on the contrary, by a mobile energy unit provided on site, which generates the voltage through a number of series-connected lithium batteries, with sufficiently thick current cables, so that a current with a high amperage may be provided to the SMA flat steel. The heating should only be so brief, that within 2 to 5 seconds of continuous electric supply, the required temperature of about 100° to 250° C. is achieved in the SMA flat steel 2, generating the required contraction force. Therefore, damages to adjoining concrete are avoided. To this end, two conditions have to be met, i.e. in the first place, a current of about 10-20 A per $mm^2$ of cross sectional surface area are required, and, secondly, about 10-20V per 1 m of flat steel length, in order to reach, within seconds, the austenitic state of the flat steel. The batteries have to be series-connected. The number, size and type of batteries have to be selected accordingly, so that the required current (Ampere) and voltage (Volt) may be obtained, and the energy consumption has to be controlled by a controller, so that by push-button, adapted to a certain flat steel length and thickness, the voltage is kept applied over the flat steel for the correct time duration, during which the required current flows. In case of long flat steels of several meters of length, the heating may be applied stepwise, in that at certain intervals electric connectors are provided, where the voltage may be applied. In this way, the required heat may be input segment-wise, one segment after the other, along the entire length of a flat steel, in order to finally transition the entire length of steel into the austenitic state.

LIST OF REFERENCES

1 tension element, flat steel
2 structure, structural part
3 electrical connectors
4 end anchors
5 corners
6 end region of tension element or flat steel
7 structural part, cantilevered
8 screw
9 lock nut for screw 8
10 rings, overlapping regions
11 silos
12 intermediate anchor
13 hook at end of flat steel
14 steel connection elements
15 support
16 beam
17 bolt for hook 13
18 adhesive

The invention claimed is:

1. A method for producing a prestressed structure via one or more tension elements comprised of a shape memory alloy for reinforcing of a structure and having a polymorphic and polycrystalline structure, which, by increasing its temperature, is able to be brought from a martensitic state to a permanent austenitic state, said method comprising the steps of:

extending on the structure a tension element that is guided around a corner or a curvature of the structure;

wherein the tension element is secured to the structure by at least one of, or a combination of, the following:

a) the tension element is attached to at least one end anchor that penetrates into the structure;

b) the tension element wraps around a structure as a band, wherein two ends of said tension element are connected to each other via a tensile connection;

c) the tension element wraps around the structure as a band, wherein two ends of said tension element are separately connected to the structure via at least one end anchor or at least one intermediate anchor which penetrates into the structure; or d) the tension element overlaps or crosses on itself at least once in a clamping manner;

heating the tension element, utilizing an active and controlled heat input in order to contract the tension element and generate a permanent tension;

wherein the heating of the tension element is performed via electric contacts on the end regions of the tension element, by applying a voltage to the tension element, such that the electrical resistance of the tension element causes the tension element to increase in temperature and transition from the martensitic state to the permanent austenitic state, such that the tension element exerts a permanent or residual tension up to fracture load of the structure.

2. The method for producing a prestressed structure via one or more tension elements comprised of a shape memory alloy according to claim 1, wherein the tension element provided in the form of bands of flat steel, and wherein during the securing of the tension element to the structure additional bolts are used, which cross the tension elements.

3. The method for producing a prestressed structure via one or more tension elements comprised of a shape memory alloy according to claim 1, wherein the tension element is a flat steel sheet, band or plate made of a shape memory alloy including one or multiple curvatures on the outer side of the structure.

4. The method for producing a prestressed structure via one or more tension elements comprised of a shape memory alloy according to claim 1, wherein said tension element is a flat steel sheet, band or plate made of a shape memory alloy and both ends of the flat steel sheet, band or plate are mechanically connected to each other.

5. The method for producing a prestressed structure via one or more tension elements comprised of a shape memory alloy according to claim 1, wherein said tension element is a flat steel sheet, band or plate made of a shape memory alloy and both ends of the flat steel sheet, band or plate are mechanically connected to each other with at least one screw passing through an overlapping portion of both ends of the flat steel sheet, band or plate, or, or are mechanically connected to each other with end hook and a bolt.

6. The method for producing a prestressed structure via one or more tension elements comprised of a shape memory alloy according to claim 1, wherein said tension element is in the form of a flat steel band made of an iron-based shape memory alloy on which is wrapped around the structure, so that said tension element overlaps over itself in a region;

wherein when the voltage is applied to the tension element the band causes a permanent binding on the structural part and the overlapping region generates an adhesive friction force.

7. The method for producing a prestressed structure via one or more tension elements comprised of a shape memory alloy according to claim 1, wherein the securing of the tension element also includes anchoring the tension element to the structure via at least one of a dowel, an expansion dowel, a nail, an anchor, an adhesive anchor, a concrete-filled anchor, riveting and screwing.

8. The method for producing a prestressed structure via one or more tension elements comprised of a shape memory alloy according to claim 1, wherein the securing of the tension element also includes anchoring the tension element to the structure via a step of gluing of said tension element to the structure using an epoxy or polyurethane adhesive, wherein said tension element includes at least one roughened surface for improving the adhesive bond.

9. The method for producing a prestressed structure via one or more tension elements comprised of a shape memory alloy according to claim 8, wherein the end anchor of said tension element is only utilized during the prestressing of the tension element and is thereafter removed, such that the transmission of the fracture load of the tension element to the structure is provided by the hardened adhesive between the structure and the tension element.

10. The method for producing a prestressed structure via one or more tension elements comprised of a shape memory alloy according to claim 8, wherein the end anchoring of said tension element is removed after hardening of the adhesive.

* * * * *